US009639047B2

(12) United States Patent
Furukawa

(10) Patent No.: US 9,639,047 B2
(45) Date of Patent: May 2, 2017

(54) IMAGE FORMING APPARATUS, CONTROL METHOD AND NON-TRANSITORY COMPUTER-READABLE MEDIUM

(71) Applicant: Brother Kogyo Kabushiki Kaisha, Nagoya-shi, Aichi-ken (JP)

(72) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/009,222

(22) Filed: Jan. 28, 2016

(65) Prior Publication Data

US 2016/0224872 A1 Aug. 4, 2016

(30) Foreign Application Priority Data

Jan. 30, 2015 (JP) ..... 2015-017445

(51) Int. Cl.
*G03G 15/00* (2006.01)

(52) U.S. Cl.
CPC ..... *G03G 15/55* (2013.01); *G03G 15/5058* (2013.01); *G03G 2215/0141* (2013.01)

(58) Field of Classification Search
CPC ..... G03G 15/00042; G06K 15/27
See application file for complete search history.

(56) References Cited

U.S. PATENT DOCUMENTS

| | | | | |
|---|---|---|---|---|
| 8,879,113 | B2 | 11/2014 | Zaima | |
| 8,928,942 | B2 | 1/2015 | Nakajima | |
| 2012/0051768 | A1* | 3/2012 | Nakatsuji | G03G 15/5058 399/49 |
| 2013/0016365 | A1 | 1/2013 | Zaima | |
| 2014/0253930 | A1 | 9/2014 | Nakajima | |

FOREIGN PATENT DOCUMENTS

| | | | |
|---|---|---|---|
| JP | 2005-331658 | A | 12/2005 |
| JP | 2013-020153 | A | 1/2013 |
| JP | 2014-174400 | A | 9/2014 |

* cited by examiner

*Primary Examiner* — Clayton E Laballe
*Assistant Examiner* — Victor Verbitsky
(74) *Attorney, Agent, or Firm* — Banner & Witcoff, Ltd.

(57) ABSTRACT

An image forming apparatus includes an image forming device for forming a pattern image having unit images on a photosensitive member, a sensor for irradiating the pattern image with light and detecting reflected light, and a controller for controlling the image forming device to form a pattern image for printing used when printing and a pattern image for detection to be detected by the sensor on the photosensitive member. A first pattern image for printing includes a predetermined number of first unit images arranged to be spaced from each other, each of the first unit images being smaller than a predetermined size. A first pattern image for detection corresponding to the first pattern image for printing includes more than the predetermined number of the first unit images arranged to be spaced from each other.

18 Claims, 9 Drawing Sheets

FIG. 7A PATTERN IMAGE FOR PRINTING
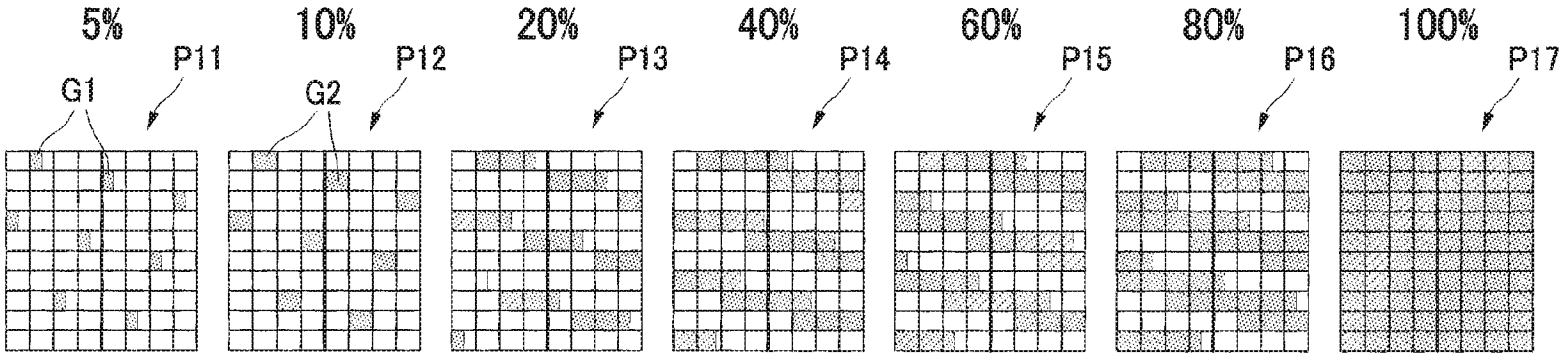
FIG. 7B PATTERN IMAGE FOR DETECTION
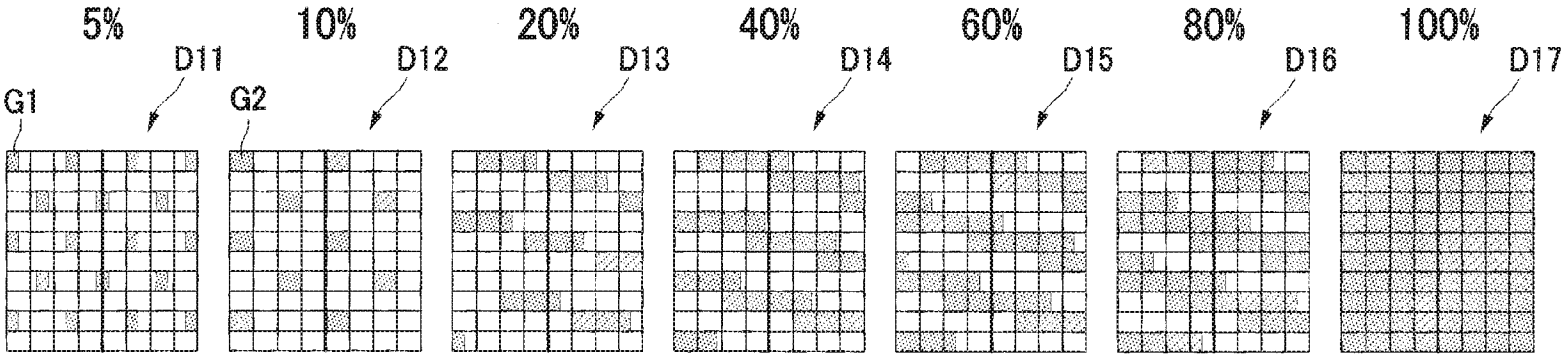

FIG. 8A PATTERN IMAGE FOR PRINTING
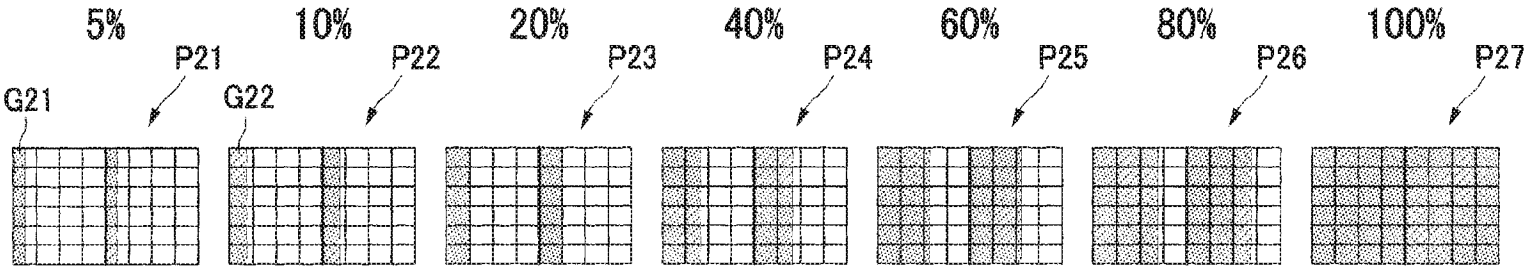
FIG. 8B PATTERN IMAGE FOR DETECTION
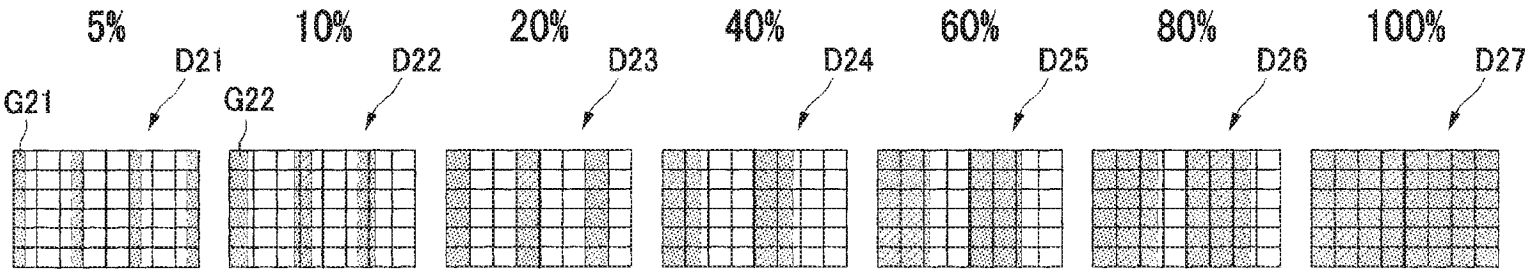

FIG. 9A PATTERN IMAGE FOR PRINTING
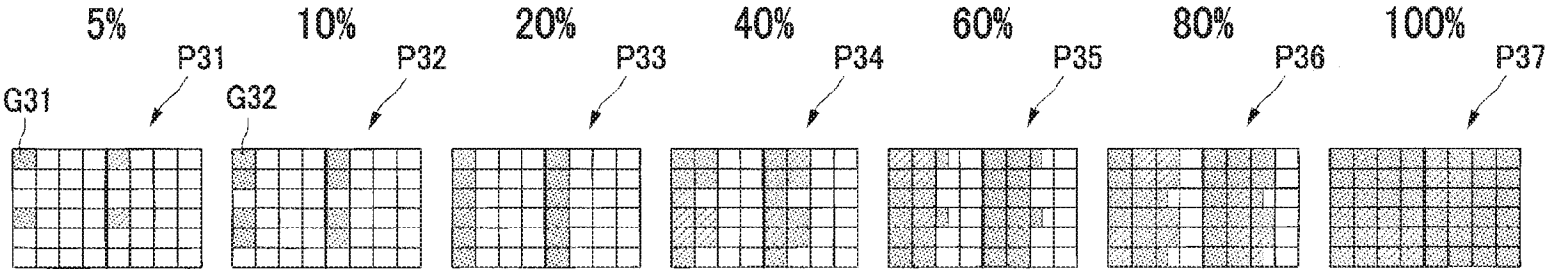
FIG. 9B PATTERN IMAGE FOR DETECTION
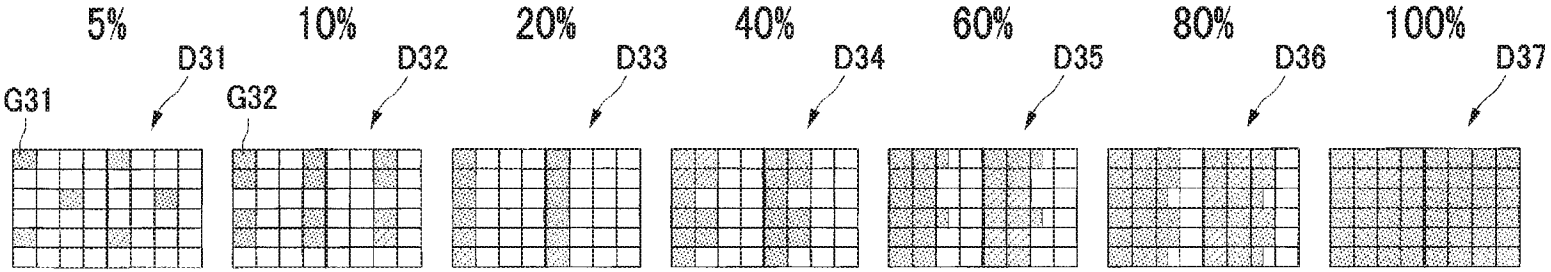

IMAGE FORMING APPARATUS, CONTROL METHOD AND NON-TRANSITORY COMPUTER-READABLE MEDIUM

CROSS-REFERENCE TO RELATED APPLICATION

This application claims priority from Japanese Patent Application No. 2015-017445 filed on Jan. 30, 2015, the entire subject-matter of which is incorporated herein by reference.

TECHNICAL FIELD

The disclosure relates to an image forming apparatus having a controller configured to form a pattern image for printing or a pattern image for detection on a photosensitive member, a control method by the controller and a non-transitory computer-readable medium having a program for operating the controller.

BACKGROUND

There has been proposed a technology of forming a plurality of density patches having different gradations on a photosensitive drum and correcting each gradation characteristic of each density patch on the basis of a detection result of each density patch on the photosensitive drum by an optical sensor. According to the related-art technology, a gradation characteristic of image data, which is a printing target, is corrected on the basis of a detection result of a pattern image for detection, which is to be detected by the optical sensor, by the optical sensor. Also, according to the related-art technology, the pattern image for detection in a low gradation area is configured by a plurality of isolated unit images, and a size of the unit image becomes larger as the density increases.

However, according to the related-art technology, when forming the pattern image for detection in the low gradation area on the photosensitive member, the unit image becomes small with respect to a base of the photosensitive member, so that an S/N ratio of a detection signal decreases upon the detection by the optical sensor.

SUMMARY

According to one illustrative aspect, there may be provided an image forming apparatus comprising: an image forming device configured to form a pattern image, in which unit images are arranged, on a photosensitive member; a sensor configured to irradiate the pattern image with light and to detect reflected light; and a controller configured to control the image forming device to form a pattern image for printing and a pattern image for detection on the photosensitive member, the pattern image for printing being to be used when printing, and the pattern image for detection being to be detected by the sensor. A first pattern image for printing comprises a predetermined number of first unit images, the first unit images being arranged with being spaced from each other per a predetermined area, each of the first unit images being smaller than a predetermined size. A first pattern image for detection, which corresponds to the first pattern image for printing, comprises more than the predetermined number of the first unit images, the first unit images being arranged with being spaced from each other per the predetermined area.

When the unit image is the first unit image smaller than a predetermined size, the light reflected on a medium on which the pattern image is formed is likely to be a noise, so that an S/N ratio of the detection signal decreases. Therefore, when the number of the first unit images in the first pattern image for detection is increased to reduce an area of the medium, it is possible to suppress the decrease in the S/N ratio of the detection signal. In the meantime, it is possible to reduce the area of the medium just by connecting and arranging the first unit images. In this case, however, since the shape of the first unit image is changed, the number of the first unit images and an amount of toner may not form a proportional relation. In contrast, when the respective first unit images are arranged with being spaced from each other, it is possible to maintain the shape of each first unit image at the same shape. Therefore, the number of the first unit images and the amount of the toner can be made to be substantially proportional and the density correction can be easily performed thereafter.

In the above-described configuration, the controller may be configured to: detect the pattern image for detection corresponding to the pattern image for printing; and change a size of the unit image of the pattern image for printing corresponding to a predetermined printing density on the basis of a result of the detection.

In the above-described configuration, the pattern image for printing may comprise the predetermined number of unit images arranged per the predetermined area, a size of the unit image becoming larger as a printing density increases.

In the above-described configuration, the first pattern image for printing may comprise the smallest unit images among the unit images.

According to the above configuration, it is possible to improve the detection accuracy of the lowest density by setting the first pattern image for detection in correspondence to the first pattern image for printing, which is closest to 0%, of the pattern images for printing for expressing a plurality of gradations.

In the above-described configuration, the image forming unit may comprise: an exposure unit configured to form an electrostatic latent image on the photosensitive member; a developing unit configured to supply developer to the electrostatic latent image on the photosensitive member to form the pattern image; a belt contactable with the photosensitive member; and a transfer unit configured to transfer the pattern image on the photosensitive member to the belt, and the controller may be configured to perform: printing control comprising: forming the pattern image for printing on the photosensitive member; and transferring the pattern image for printing from the photosensitive member to a recording sheet directly or via the belt; and detection control comprising: forming the pattern image for detection on the photosensitive member; transferring the pattern image for detection from the photosensitive member to the belt; and detecting the pattern image for detection by the sensor.

According to a control method of an image forming unit, the image forming unit being configured to form a pattern image for printing and a pattern image for detection on a photosensitive member, the pattern image for printing being to be used upon printing and the pattern image for detection being to be detected by a sensor using light, the control method comprises: controlling the image forming unit to form a first pattern image for printing on the photosensitive member, the first pattern image for printing comprising a predetermined number of first unit images, the first unit images being arranged with being spaced from each other per a predetermined area, each of the first unit images being smaller than a predetermined size, and controlling the image forming unit to form a first pattern image for detection corresponding to the first pattern for printing on the photosensitive member, the first pattern image for detection comprising more than the predetermined number of the first unit images, the first unit images being arranged with being spaced from each other per the predetermined area.

According to the control method, it is possible to accomplish the same effects as the above.

According to a non-transitory computer-readable medium having a program stored thereon and readable by a controller configured to control an image forming unit, the image forming unit being configured to form a pattern image for printing and a pattern image for detection on a photosensitive member, the pattern image for printing being to be used upon printing and the pattern image for detection being to be detected by a sensor using light, the computer program, when executed by the computer, causes the controller to function as: a first unit configured to form a first pattern image for printing on the photosensitive member, the first pattern image for printing comprising a predetermined number of first unit images, the first unit images being arranged with being spaced from each other per a predetermined area, each of the first unit images being smaller than a predetermined size; and a second unit configured to form a first pattern image for detection corresponding to the first pattern for printing on the photosensitive member, the first pattern image for detection comprising more than the predetermined number of the first unit images, the first unit images being arranged with being spaced from each other per the predetermined area.

According to the non-transitory computer-readable medium having the program, it is possible to accomplish the same effects as the above.

According to the disclosure, it is possible to suppress the S/N ratio of the detection signal from decreasing even when the unit image configuring the pattern image for detection, which is to be detected by the sensor, is small.

BRIEF DESCRIPTION OF THE DRAWINGS

FIG. 2 is a configuration view depicting a controller and the like;

FIGS. 7A and 7B depict a first modified embodiment of the pattern image for printing and the pattern image for detection;

FIGS. 8A and 8B depict a second modified embodiment of the pattern image for printing and the pattern image for detection; and FIGS. 9A and 9B depict a third modified embodiment of the pattern image for printing and the pattern image for detection.

DETAILED DESCRIPTION

Illustrative aspects of the disclosure suppress an S/N ratio of a detection signal from decreasing even when a unit image configuring a pattern image for detection, which is to be detected by a sensor such as an optical sensor, is small.

Hereinafter, a color printer 1, which is an example of the image forming apparatus according to an illustrative embodiment of the disclosure, will be described in detail with reference to the drawings. In the below descriptions, the left side of FIG. 1 is referred to as the 'front,' the right side of FIG. 1 is referred to as the 'rear,' the front side of FIG. 1 is referred to as the 'right' and the inner side of FIG. 1 is referred to as the 'left.' Also, the upper and lower directions of FIG. 1 are referred to as the 'upper-lower.'

Figure 1:
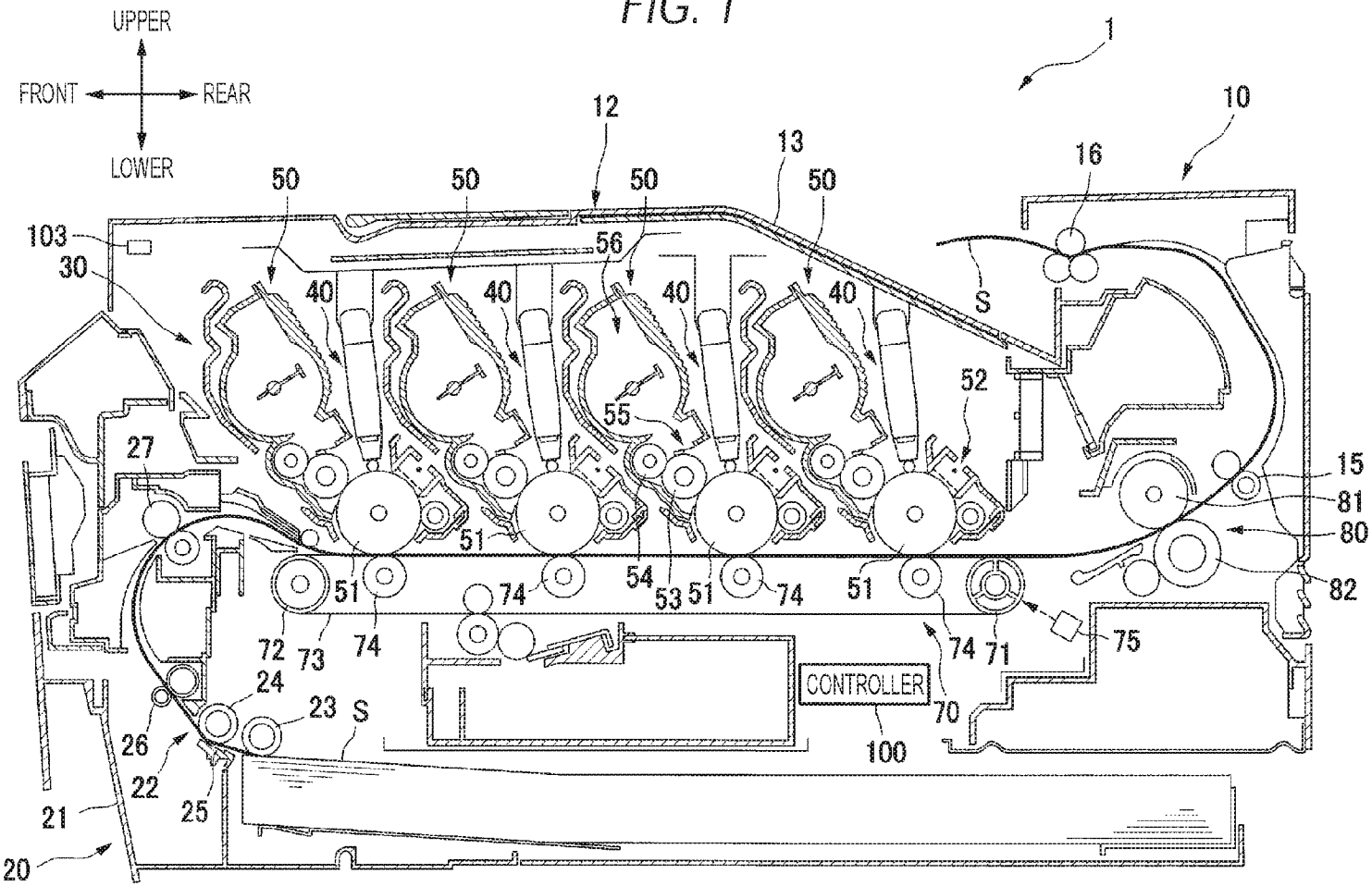
FIG. 1 depicts a schematic configuration of a color printer according to an illustrative embodiment of the disclosure.

As shown in FIG. 1, the color printer 1 mainly has, in a housing 10, a feeder unit 20, an image forming unit 30 and a controller 100. The housing 10 is provided at its upper side with an upper cover 12 that is configured to be rotatable in the upper-lower direction at a rear side serving as a support point and to open/close the upper of the housing 10. In the housing 10, a temperature sensor 103 configured to detect a temperature in the housing 10 is provided.

The feeder unit 20 is provided at the lower in the housing 10 and has a sheet feeding tray 21 that is configured to accommodate therein a sheet S, which is an example of the recording sheet, and a feeding mechanism 22 that is configured to feed the sheet S from the sheet feeding tray 21 to the image forming unit 30. The feeding mechanism 22 has a pickup roller 23, a separation roller 24, a separation pad 25, paper powder pickup rollers 26 and registration rollers 27.

In the feeder unit 20, the sheets S in the sheet feeding tray 21 are delivered by the pickup roller 23 and are then separated one by one between the separation roller 24 and the separation pad 25. Thereafter, paper powders of the sheet S are removed by the paper powder pickup rollers 26 and a tip position of the sheet is regulated by the stationary registration rollers 27. Then, when the registration rollers 27 are rotated, the sheet is fed to the image forming unit 30.

The image forming unit 30 has four LED (which is an abbreviation of Light Emitting Diode) units 40, which are an example of the exposure unit, four process cartridges 50, a transfer unit 70 and a fixing unit 80.

The LED unit 40 is arranged above a photosensitive drum 51, which is an example of the photosensitive member, with facing the same, and has a plurality of LEDs (not shown) aligned in the left-right direction on a lower end thereof. The LED unit 40 is configured such that the light emitting parts thereof are blinked on the basis of the image data, thereby exposing a surface of the photosensitive drum 51.

The process cartridges 50 are disposed side by side in the front-rear direction between the upper cover 12 and the sheet feeding tray 21 and can be attached and detached to and from the housing 10 with the upper cover 12 being opened. Each process cartridge 50 has the photosensitive drum 51, a charger 52, a developing roller 53, a supply roller 54, a layer thickness regulation blade 55, and a toner accommodation unit 56 configured to accommodate therein positively-charged toner, which is an example of the developer. Here, the developing roller 53, the supply roller 54, the layer thickness regulation blade 55 and the toner accommodation unit 56 correspond to the developing unit.

The transfer unit 70 is provided between the feeder unit 20 and the process cartridges 50, and has a driving roller 71, a driven roller 72, a conveyor belt 73 configured by an endless belt, four transfer rollers 74, which are an example of the transfer unit, and a patch detection sensor 75, which is an example of the sensor. The conveyor belt 73 is provided with being stretched between the driving roller 71 and the driven roller 72, an outer surface thereof is in contact with the respective photosensitive drums 51 and the respective transfer rollers 74 are disposed at an inner side of the conveyor belt such that the conveyor belt 73 is interposed between the respective transfer rollers and the respective photosensitive drums 51.

The patch detection sensor 75 is a sensor configured to detect a toner patch for density correction formed on the conveyor belt 73, and is disposed at the rear of the conveyor belt 73 with facing the same. The patch detection sensor 75 is a light reflection-type sensor having a light emitting element such as an LED and a light receiving element such as a photo transistor, and is configured to irradiate light to the toner patch and to detect the reflected light. In other words, the patch detection sensor 75 is configured to detect a toner image, which is to be formed as the toner is supplied to an electrostatic latent image for test formed on the photosensitive drum 51, i.e., the toner patch via the conveyor belt 73.

The fixing unit 80 is provided at the rear of the process cartridges 50 and the transfer unit 70, and has a heating roller 81 and a pressing roller 82 arranged to face the heating roller 81 and to press the heating roller 81.

In the image forming unit 30 configured as described above, the surface of each photosensitive drum 51 is uniformly charged by the charger 52 and is then exposed by the LED light irradiated from each LED unit 40. Thereby, an electrostatic latent image based on the image data is formed on each photosensitive drum 51.

Also, the toner in the toner accommodation unit 56 is supplied to the developing roller 53 by rotation of the supply roller 54, and is then introduced between the developing roller 53 and the layer thickness regulation blade 55 by rotation of the developing roller 53 and carried on the developing roller 53, as a thin layer having a predetermined thickness.

The toner carried on the developing roller 53 is supplied to the electrostatic latent image formed on the photosensitive drum 51 when the developing roller 53 is contacted to the photosensitive drum 51 with facing the same. Thereby, the toner is selectively carried on the photosensitive drum 51, so that the electrostatic latent image becomes visible and a toner image is thus formed.

Then, when the sheet S fed onto the conveyor belt 73 passes between the respective photosensitive drums 51 and the respective transfer rollers 74, the toner images formed on the respective photosensitive drums 51 are transferred to the sheet S. Then, the sheet S passes between the heating roller 81 and the pressing roller, so that the toner images transferred to the sheet S are heat-fixed.

Also, when detecting a printing density of the toner patch, an electrostatic latent image for test is formed on the surface of the photosensitive drum 51 by using a pattern image for detection, which will be described later, and the toner is then supplied from the developing roller 53 to the electrostatic latent image for test, so that a toner patch is formed on the photosensitive drum 51. After the toner patch formed on the photosensitive drum 51 is transferred to the conveyor belt 73 by the transfer roller 74, the reflected light corresponding to a printing density, specifically, a printing density of the toner patch is detected by the patch detection sensor 75. Meanwhile, in the below descriptions, the detection control for detecting a printing density of the toner patch is also referred to as patch test.

Conveyor rollers 15 are provided at the rear of the fixing unit 80 and discharging rollers 16 are provided above the fixing unit. The sheet S discharged from the fixing unit 80 is discharged to an outside of the housing 10 by the conveyor rollers 15 and the discharging rollers 16 and is stacked on a sheet discharging tray 13.

Subsequently, the controller 100 is described in detail.

Figure 2:
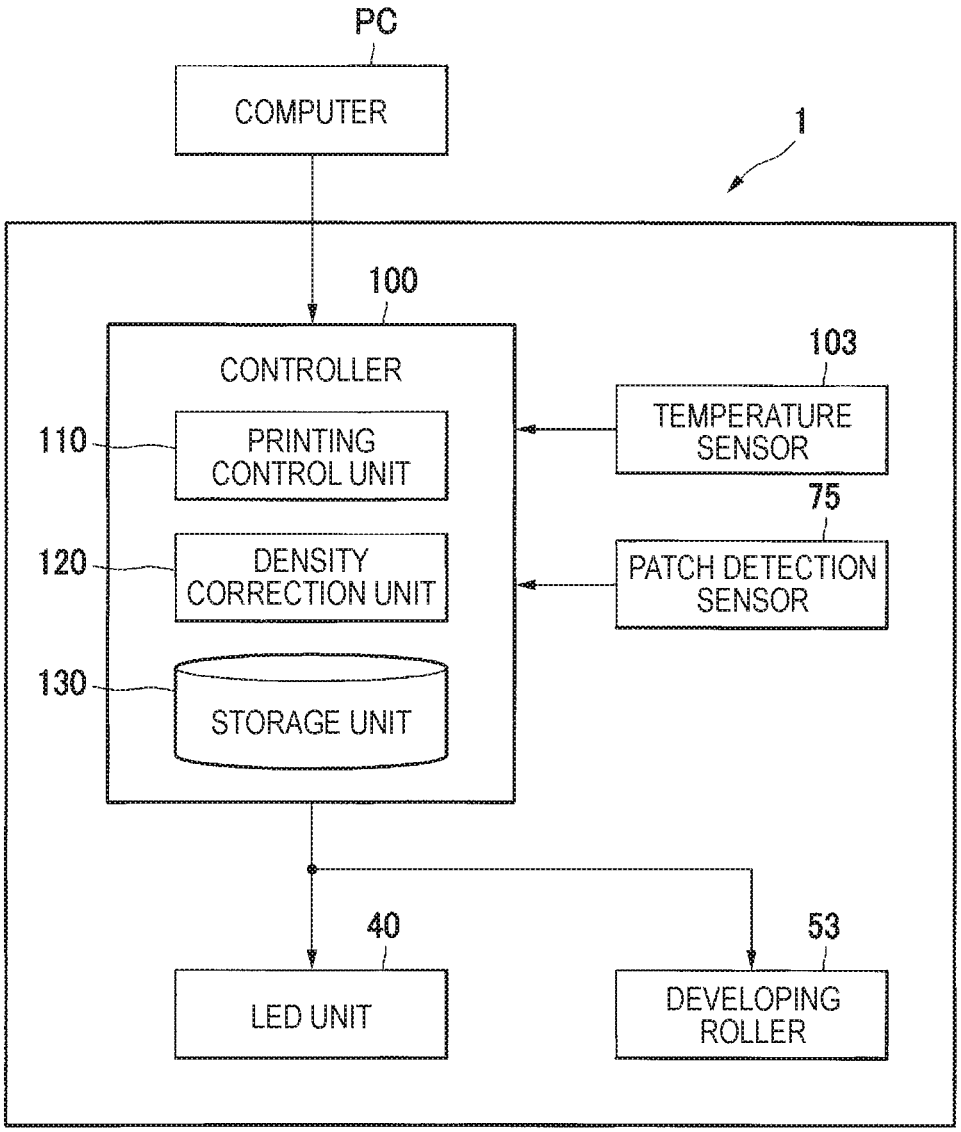

The controller 100 has a CPU, a RAM, a ROM and an input/output circuit, and is configured to execute a variety of calculation processing on the basis of a printing job output from an external computer PC, information output from the respective sensors 103, 75 and a program and data stored in the ROM and the like, thereby executing the control, as shown in FIG. 2. Specifically, the controller 100 has a printing control unit 110, which is an example of the first unit, a density correction unit 120, which is an example of the second unit, and a storage unit 130. In other words, the controller 100 is configured to operate on the basis of the program stored in the storage unit 130, thereby functioning as the printing control unit 110 and the density correction unit 120. That is, the controller 100 may be configured by a processor and a memory storing instructions which, when executed by the processor, cause the color printer 1 to perform predetermined operations.

The printing control unit 110 has a function of executing printing control for forming an image on the sheet S on the basis of a printing job output from the computer PC. Specifically, when executing the printing for a predetermined part of the sheet S upon execution of the printing control, the printing control unit 110 selects one pattern image for printing from a plurality of pattern images for printing corresponding to different exposure densities as exemplified in FIG. 3 such that a printing density of the predetermined part becomes a desired density.

Here, the printing density indicates a density of toner in a predetermined area on the sheet S. An exposure density indicates a density associated with an exposure pattern on the photosensitive drum 51 corresponding to a certain printing density under standard conditions. In the meantime, the pattern image for printing indicates not only a toner image actually formed on the photosensitive drum 51, the sheet S and the like but also an exposure pattern for forming the toner image. That is, the pattern image for printing indicates an arrangement of dots on a base part. For example, when the base part is a sheet, the pattern image for printing is indicative of an arrangement of toners, and when the base part is a non-exposed part of the photosensitive drum 51, the pattern image for printing indicates an arrangement of exposed parts. This is also the same for a pattern image for detection that will be described later.

After the printing control unit 110 selects one pattern image for printing from the plurality of the pattern images for printing, as described above, the printing control unit 110 executes the exposure/developing by using the pattern image for printing, thereby forming the pattern image for printing on the photosensitive drum 51.

Figure 3:
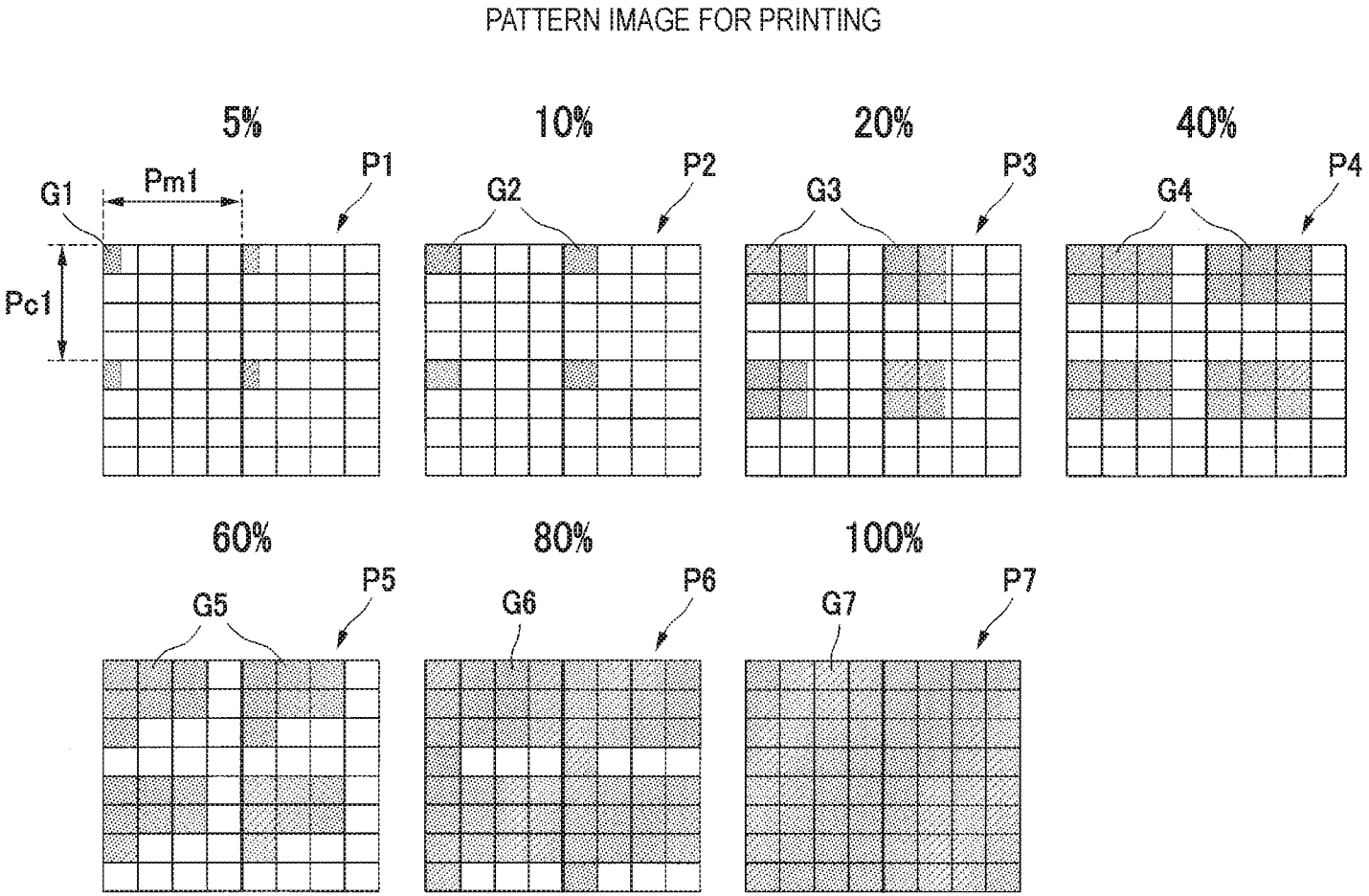
FIG. 3 depicts pattern images for printing.

In the meantime, the pattern images for printing P1 to P7 are stored in advance in the storage unit 130 with being associated with the exposure densities 5%, 10%, 20%, 40%, 60%, 80% and 100%. In FIG. 3, the pattern images for printing P1 to P7 corresponding to the respective exposure densities 5%, 10%, 20%, 40%, 60%, 80% and 100% are exemplified. However, actually, patterns image for printing corresponding to the other exposure densities such as 90%, for example, are also stored in advance in the storage unit 130. In the meantime, the respective pattern images for printing P1 to P7 will be described in detail.

The density correction unit 120 has functions of executing developing bias correction for correcting a developing bias on the basis of a detection result by the patch detection sensor 75 and gamma (γ) correction for correcting a relation between the printing density and the exposure density on the basis of a detection result by the patch detection sensor 75. Specifically, the density correction unit 120 is configured to perform a mode in which only the developing bias correction is to be executed and a mode in which both the developing bias correction and the gamma correction are to be executed, based on a variety of conditions that will be described in detail later.

Upon the developing bias correction, the density correction unit 120 is configured to execute the patch test by using a pattern image having pixels coarser than the pattern image for printing corresponding to the exposure density 50% and two developing biases. Specifically, the density correction unit 120 is configured to form two electrostatic latent images on the photosensitive drum 51 by using a pattern image having coarse pixels and to develop the two electrostatic latent images by the two developing biases, thereby forming toner patches having two printing densities on the photosensitive drum 51. Thereafter, the density correction unit 120 is configured to transfer the respective toner patches from the photosensitive drum 51 to the conveyor belt 73 and to detect the respective toner patches on the conveyor belt 73 by the patch detection sensor 75. Then, the density correction unit 120 is configured to convert intensities of the reflected lights from the respective toner patches detected by the patch detection sensor 75 into printing densities, to calculate a developing bias corresponding to a normal printing density on the basis of the two printing densities and the two developing biases, and to overwrite the calculated developing bias over the previous developing bias.

Upon the gamma correction, the density correction unit 120 is configured to execute the patch test by using respective pattern images for detection D1 to D7 (refer to FIG. 4) corresponding to the respective pattern images for printing P1 to P7. Here, the respective pattern images for detection D1 to D7 are stored in advance in the storage unit 130 with being associated with the exposure densities 5%, 10%, 20%, 40%, 60%, 80% and 100%.

The gamma correction is described in detail. Upon the gamma correction, the density correction unit 120 is configured to form seven electrostatic latent images on the photosensitive drum 51 by using the respective pattern images for detection D1 to D7 corresponding to the exposure densities 5%, 10%, 20%, 40%, 60%, 80% and 100% and to develop the respective electrostatic latent images by the developing bias set at that time, thereby forming toner patches having seven printing densities. Thereafter, the density correction unit 120 is configured to detect the respective toner patches transferred from the photosensitive drum 51 to the conveyor belt 73 by the patch detection sensor 75 and to convert intensities of the reflected lights from the respective toner patches into printing densities. Then, the density correction unit 120 is configured to compare the calculated printing densities and the corresponding exposure densities. When the compared printing density and exposure density are different, the density correction unit 120 corrects a relation between the printing density and the exposure density. In the meantime, the correction will be described in detail later.

Subsequently, the respective pattern images for printing P1 to P7 and the respective pattern images for detection D1 to D7 are described in detail.

As shown in FIG. 3, the first pattern image for printing P1 corresponding to the exposure density 5% is an image obtained by cutting 8×8 cells from a pattern for printing corresponding to the exposure density 5%. The first pattern image for printing P1 has a configuration where four first unit images G1 are arranged in a ratio of one per 16 cells with being spaced from each other. In other words, the first pattern image for printing P1 has a configuration where four first unit images G1 are arranged per 64 cells (8×8 cells) with being spaced from each other. Here, a dot density per one cell of the first pattern image for printing P1 may be 150 dpi, for example.

Specifically, the four first unit images G1 included in the first pattern image for printing P1 are arranged with being spaced by a first main scanning direction pitch Pm1 in a main scanning direction, i.e., in the shown left-right direction and are also arranged with being spaced by a first sub-scanning direction pitch Pc1 in a sub-scanning direction, i.e., in the shown upper-lower direction. Here, each pitch Pm1, Pc1 has the same length, specifically, a length of 4 cells.

The first unit image G1 has a rectangular shape where a length thereof in the main scanning direction is shorter than a length in the sub-scanning direction and is long in the sub-scanning direction. The first unit image G1 is a unit image smaller than the other unit images G2 to G7 (which will be described later), specifically, is the smallest unit image in this illustrative embodiment.

The second pattern image for printing P2 corresponding to the exposure density 10% has a configuration where four second unit images G2 are arranged in a ratio of one per 16 cells with being spaced from each other. The pitches of the second unit image G2 in the main scanning direction and in the sub-scanning direction are the same as the pitches Pm1, Pc1. The second unit image G2 has a shape filling up one cell and a size thereof is greater than the first unit image G1.

The third pattern image for printing P3 corresponding to the exposure density 20% has a configuration where four third unit images G3 are arranged in a ratio of one per 16 cells with being spaced from each other. The pitches of the third unit image G3 in the main scanning direction and in the sub-scanning direction are the same as the pitches Pm1, Pc1. The third unit image G3 has a shape filling up four adjacent cells and a size thereof is greater than the second unit image G2.

The fourth pattern image for printing P4 corresponding to the exposure density 40% has a configuration where four fourth unit images G4 are arranged in a ratio of one per 16 cells with being spaced from each other. The pitches of the fourth unit image G4 in the main scanning direction and in the sub-scanning direction are the same as the pitches Pm1, Pc1. The fourth unit image G4 has a shape filling up six adjacent cells and a size thereof is greater than the third unit image G3.

The fifth pattern image for printing P5 corresponding to the exposure density 60% has a configuration where four fifth unit images G5 are arranged in a ratio of one per 16 cells with being spaced from each other. The pitches of the fifth unit image G5 in the main scanning direction and in the sub-scanning direction are the same as the pitches Pm1, Pc1. The fifth unit image G5 has a shape filling up seven adjacent cells and a size thereof is greater than the fourth unit image G4.

The sixth pattern image for printing P6 corresponding to the exposure density 80% has one sixth unit image G6. The sixth unit image G6 has a shape where the fifth unit images G5 extend in the main scanning direction and the sub-scanning direction by one cell and are then connected to each other, and a size thereof is greater than the fifth unit image G5.

The seventh pattern image for printing P7 corresponding to the exposure density 100% has one seventh unit image G7. The seventh unit image G7 has a shape filling up all of 64 cells, and a size thereof is greater than the fifth unit image G5.

In this way, the respective pattern images for printing P1 to P7 are configured such that the sizes of the unit images G1 to G7 become larger as the exposure density increases. In other words, the respective pattern images for printing P1 to P7 are configured such that the sizes of the unit images G1 to G7 become larger as the printing density increases.

Figure 4:
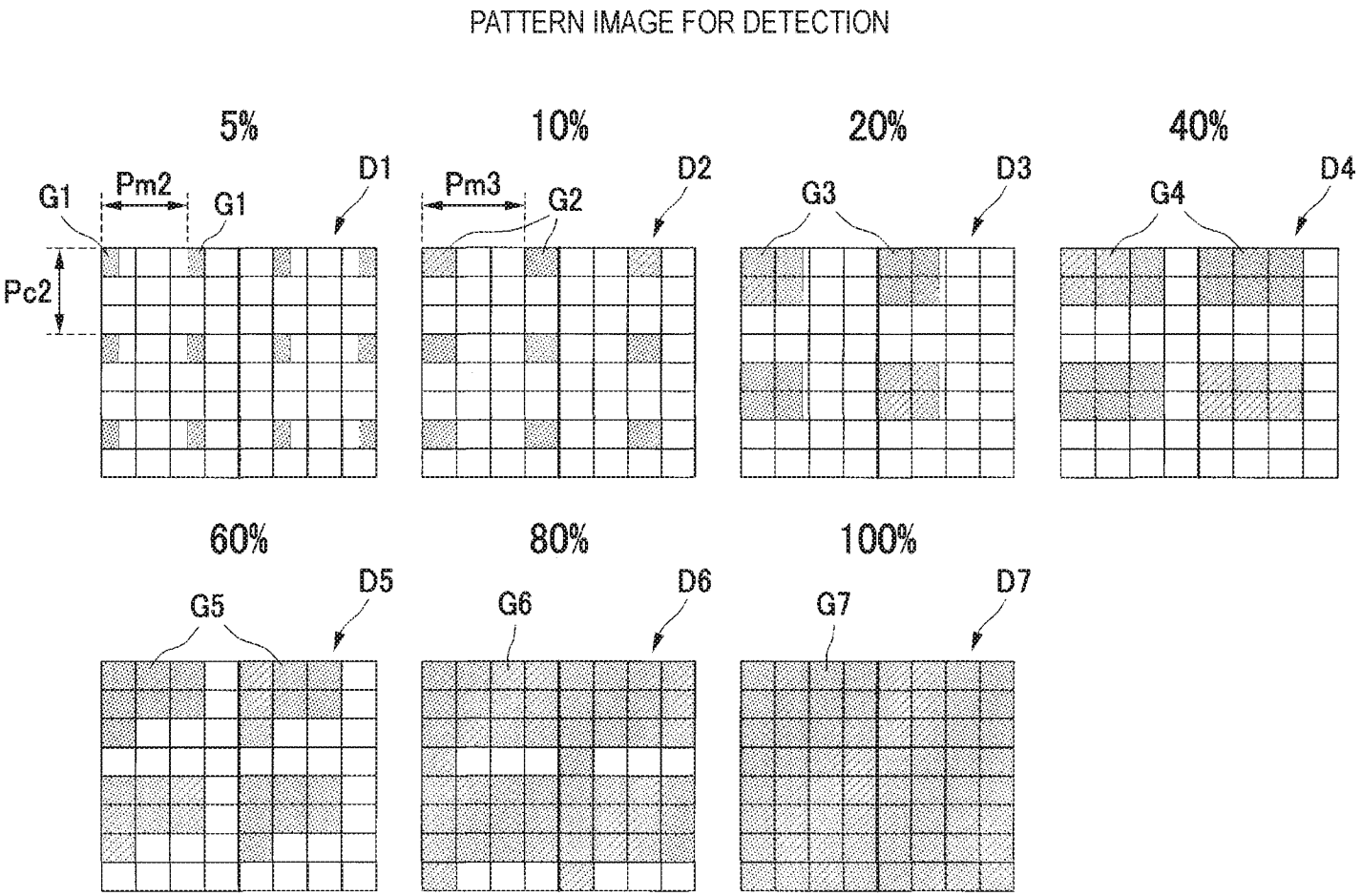
FIG. 4 depicts pattern images for detection.

As shown in FIG. 4, the first pattern image for detection D1 corresponding to the exposure density 5% is a pattern image corresponding to the first pattern image for printing P1 and obtained by cutting 8×8 cells from a pattern for detection corresponding to the exposure density 5%. The first pattern image for detection D1 has a configuration where twelve first unit images G1 are arranged in a ratio of one per 7.5 cells with being spaced from each other. In other words, the first pattern image for detection D1 has a configuration where twelve first unit images G1 are arranged per 64 cells (8×8 cells) with being spaced from each other. That is, the first pattern image for detection D1 has the same first unit images G1 as the first pattern image for printing P1, and the number of the first unit images G1 is greater than the number of the first unit images G1 of the first pattern image for printing P1.

Specifically, the twelve first unit images G1 are arranged with being spaced by a second main scanning direction pitch Pm2 smaller than the first main scanning direction pitch Pm1 (refer to FIG. 3) in the main scanning direction and are also arranged with being spaced by a second sub-scanning direction pitch Pc2 smaller than the first sub-scanning direction pitch Pc1 (refer to FIG. 3) in the sub-scanning direction. Here, the second main scanning direction pitch Pm2 has a length of about 2.5 cells and the second sub-scanning direction pitch Pc2 has a length of about 3 cells.

In the meantime, when detecting the first pattern image for detection D1 of which the number of the first unit images G1 is greater than the first pattern image for printing P1 by the patch detection sensor 75, an intensity of a signal detected by the patch detection sensor 75 is greater than an intensity of a signal obtained when the first pattern image for printing P1 is detected. For this reason, the density correction unit 120 is configured to correct a first signal intensity B1, which is to be obtained when the first pattern image for detection D1 is correctly detected, back to a second signal intensity B2, which is to be obtained when the first pattern image for printing P1 is correctly detected, by using a function of associating the first signal intensity B1 and the second signal intensity B2, for example. Specifically, for example, it is possible to obtain a signal intensity corresponding to the first pattern image for printing P1 by multiplying a signal intensity, which is to be obtained when the first pattern image for detection D1 is detected, by B2/B1. In the meantime, the correction of the signal intensity is executed when the number of the unit images is different between the pattern image for printing and the pattern image for detection.

The second pattern image for detection D2 corresponding to the exposure density 10% is a pattern image corresponding to the second pattern image for printing P2 and has a configuration where nine second unit images G2 are arranged in a ratio of one per 9 cells with being spaced from each other. That is, the second pattern image for detection D2 has the same second unit images G2 as the second pattern image for printing P2, and the number of the second unit images G2 is greater than the number of the second unit images G2 of the second pattern image for printing P2.

Specifically, the nine second unit images G2 are arranged with being spaced by a third main scanning direction pitch Pm3 smaller than the first main scanning direction pitch Pm1 (refer to FIG. 3) and greater than the second main scanning direction pitch Pm2 in the main scanning direction and are also arranged with being spaced by the second sub-scanning direction pitch Pc2 in the sub-scanning direction. Here, the third main scanning direction pitch Pm3 has a length of about 3 cells.

The pattern images for detection D3 to D7 corresponding to the respective exposure densities of 20% or greater are the same pattern images as the pattern images for printing P3 to P7 of the corresponding exposure densities, respectively.

In the storage unit 130, the respective pattern images for printing P1 to P7 and the respective pattern images for detection D1 to D7 are stored and a variety of threshold values to be used for control, a program for operating the printing control unit 110 and the density correction unit 120, and the like are also stored.

Subsequently, operations of the controller 100 are described in detail.

Figure 5:
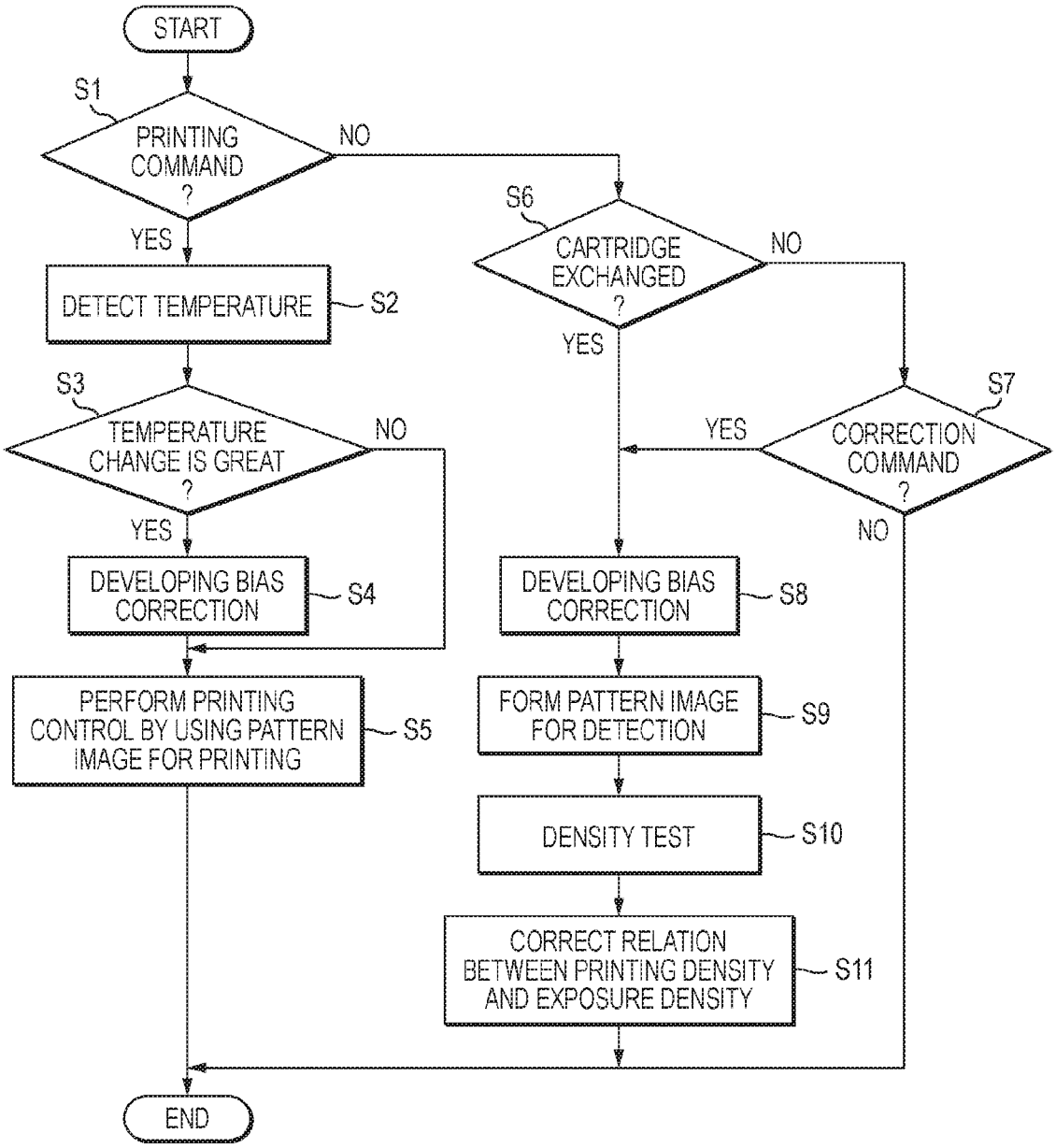
FIG. 5 is a flowchart depicting operations of the controller.

As shown in FIG. 5, the controller 100 first determines whether a printing command is issued (S1). When it is determined in step S1 that a printing command is issued (Yes), the controller 100 detects a temperature by the temperature sensor 103 (S2) and determines whether a temperature change from the previous printing control is great or not by determining whether a difference between the temperature detected this time and the temperature previously detected is equal to or greater than a predetermined value (S3).

When it is determined in step S3 that the temperature change is great (Yes), the controller 100 executes the developing bias correction (S4). After step S4 or after a determination result in step S3 is No, the controller 100 executes the printing control by using the pattern image for printing (S5).

Specifically, in step S5, when performing the printing for a predetermined part of the sheet S, the controller 100 selects the pattern image for printing associated with the exposure density corresponding to the printing density of the predetermined part instructed by the printing command, and executes the printing control by using the selected pattern image for printing. For example, when the printing density of the predetermined part instructed by the printing command is 20%, the controller 100 selects the third pattern image for printing P3 corresponding to the exposure density 20%, and performs the printing for the predetermined part by using the third pattern image for printing P3. After step S5, i.e., after the printing control is over, the controller 100 ends the control.

On the other hand, when it is determined in step S1 that there is no printing command (No), the controller 100 determines whether the process cartridge 50 has been exchanged (S6). When it is determined in step S6 that the process cartridge 50 has not been exchanged (No), the controller 100 determines whether a correction command of the printing density is issued by a user (S7). Here, the correction command of the printing density issued by a user may be a correction command that is to be output from the computer PC when the user operates the computer PC or may be a correction command that is to be output from an operation panel (not shown) provided for the color printer 1 when the user operates the operation panel.

When it is determined in step S7 that there is no correction command (No), the controller 100 ends the control. When it is determined in step S7 that there is a correction command (Yes) or when it is determined in step S6 that the process cartridge 50 has been exchanged (Yes), the controller 100 executes the developing bias correction (S8). After step S8, the controller 100 forms the seven toner patches on the conveyor belt 73 by using the seven pattern images for detection D1 to D7 corresponding to the seven exposure densities 5 to 100% (S9).

After step S9, the controller 100 detects the printing densities of the respective toner patches by using the patch detection sensor 75 (S10). After step S10, the controller 100 compares the detected printing densities and the respective exposure densities. When the detected printing density is different from the exposure density corresponding to the printing density, the controller 100 corrects the relation between the printing density and the exposure density (S11), and ends the control.

Figure 6A:
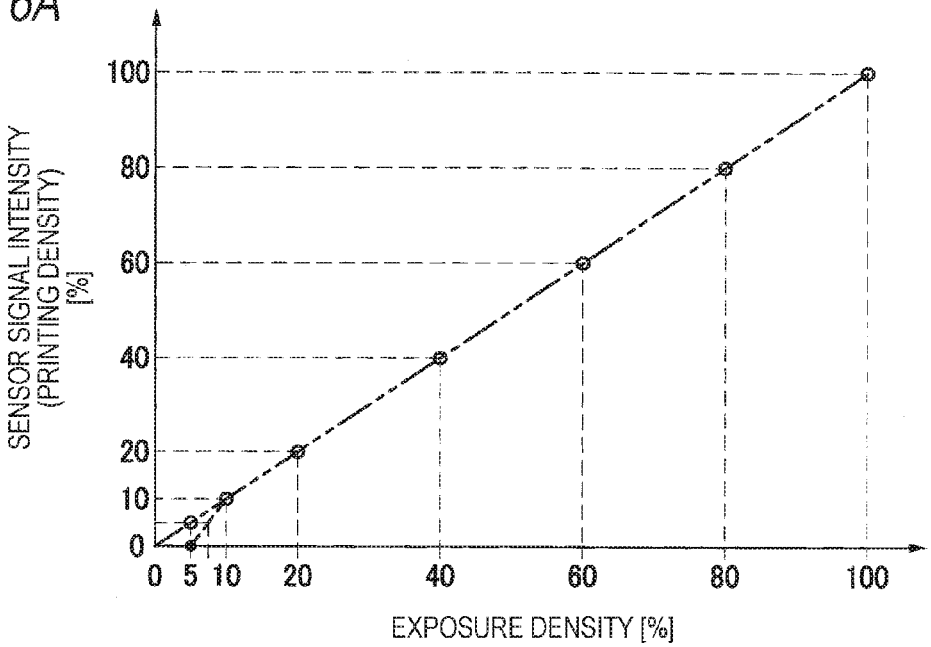
FIG. 6A depicts a relation between a printing density and an exposure density.

Here, when the correction of the relation between the printing density and the exposure density has never been executed in step S11, the printing density of the toner patch (i.e., the printing density converted from the signal intensity detected by the patch detection sensor 75) and the exposure density have the same value, as shown with the dashed-two dotted line in FIG. 6A.

Figure 6B:
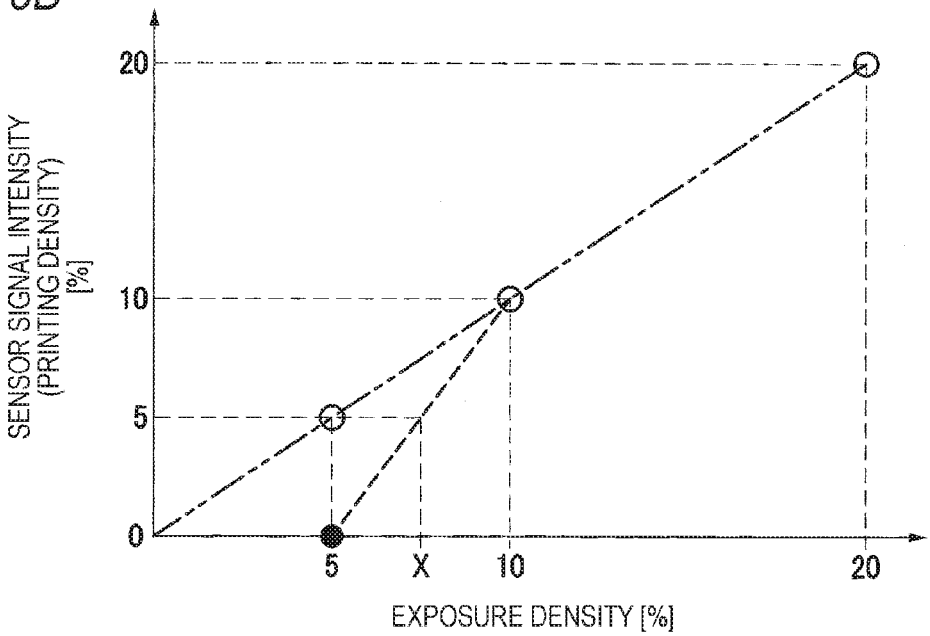
FIG. 6B is an enlarged view of a low density area of FIG. 6A.

For example, as shown with the black circle in FIG. 6B, when the toner patch formed using the first pattern image for detection D1 corresponding to the exposure density 5% cannot be detected by the patch detection sensor 75 and the printing density of the toner patch becomes 0%, the controller 100 again stores the first pattern image for printing P1, as the pattern image corresponding to the printing density 0%.

Also, at this time, when the second pattern image for detection D2 is correctly detected by the patch detection sensor 75, the exposure density between the newly set exposure density 0% and the exposure density 10% is linearly interpolated. Thereby, for example, when forming a pattern image for printing associated with the printing density 5% upon next printing control, since a pattern image for printing corresponding to an exposure density X, which is equivalent to an intersection point of a line of the printing density 5% and the dotted line, is selected, it is possible to perform the printing with the appropriate printing density by the selected pattern image for printing.

Here, the exposure density X is greater than the exposure density 5%, and the size of the unit image configuring the pattern image for printing corresponding to the exposure density X is greater than the first unit image G1 configuring the first pattern image for printing P1 corresponding to the exposure density 5%. For this reason, the controller 100 substantially changes the size the unit image of the pattern image for printing corresponding to the exposure density 5% from the size the first unit image G1 to a value greater than the same, based on the detection result by the patch detection sensor 75. In the meantime, when the printing density corresponding to the exposure density 5% becomes 0%, if the printing density of the predetermined part instructed by the printing command is 0%, the controller 100 performs the printing for the predetermined part with the exposure density 0%, not the first pattern image for printing P1 corresponding to the exposure density 5%.

According to the above illustrative embodiment, following effects can be accomplished.

Since it is possible to reduce an area of a base of the conveyor belt 73 per a predetermined area by increasing the number of the first unit images G1 in the first pattern image for detection D1, it is possible to suppress the decrease in the S/N ratio of the detection signal in the low density area.

In the meantime, it is possible to reduce the area of the base of the conveyor belt 73 just by connecting and arranging the first unit images, for example. In this case, however, since the shape of the first unit image is changed, the number of the first unit images and the amount of the toner may not form the proportional relation. In contrast, when the respective first unit images G1 are arranged with being spaced from each other, it is possible to maintain the shape of each first unit image G1 at the same shape. Therefore, the number of the first unit images G1 and the amount of the toner can be made to be substantially proportional and the density correction can be easily performed thereafter.

Specifically, for example, when the first pattern image for detection corresponding to the first pattern image for printing P1 configured by the first unit images G1 of the above illustrative embodiment is made by the same pattern image as the second pattern image for printing P2 configured by the second unit images G2 greater than the first unit images G1, following problems are caused.

When the toner is not loaded on the smallest first unit image G1 due to the deterioration of the photosensitive drum 51, for example, the toner may be loaded on the second unit image G2 greater than the first unit image G1. In this case, even though the patch test is performed by the first pattern image for detection configured by the second unit images G2, since the first pattern image for detection is normally formed, the relation between the printing density and the exposure density is not corrected. For this reason, upon next printing control, when the printing is performed with the printing density 5%, the first pattern image for printing P1 is selected and the toner is loaded on each first unit image G1 of the first pattern image for printing P1, so that the appropriate printing cannot be performed. That is, although an OK determination result is made in the patch test, a printing result in the subsequent printing control becomes NG.

In contrast, according to the above illustrative embodiment, since the first pattern image for printing P1 and the first pattern image for detection D1 are configured by the same first unit images G1, even when the number of the first unit images G1 in the first pattern image for detection D1 is large, the toner is not loaded on the first unit image G1 so that the first pattern image for detection D1 is not detected, which means, non-detection of the first pattern image for detection D1 is successful. As a result, since the relation between the printing density and the exposure density is corrected, it is possible to perform the subsequent printing control with the appropriate printing density. That is, according to the above illustrative embodiment, when the toner is not loaded on the first unit image G1, the NG determination result can be obtained by the patch test, so that it is possible to obtain the favorable printing result in the subsequent printing control.

It is possible to improve the detection accuracy of the lowest printing density by setting the first pattern image for detection D1 having the increased number of the first unit images G1 in correspondence to the first pattern image for printing P1, which is closest to 0%, of the pattern images for printing P1 to P7 for expressing a plurality of gradations.

In the meantime, the disclosure is not limited to the above illustrative embodiment and can be used in variety of forms, as exemplified later. In the below descriptions, the members having the substantially same structures as the above illustrative embodiment are denoted with the same reference numerals, and the descriptions thereof are omitted.

The pattern image for printing and the pattern image for detection are not limited to the above illustrative embodiment, and a variety of pattern images can be adopted. For example, as shown in FIGS. 7A and 7B, pattern images for printing P11 to P17 and pattern images for detection D11 to D17 may be configured.

Specifically, in the shown forms, the first pattern image for printing P11 is an image obtained by cutting 10×8 cells from the pattern for printing corresponding to the exposure density 5%. The first pattern image for printing P11 has a configuration where eight first unit images G1 are arranged in a ratio of one per 10 cells with being spaced from each other. The plurality of first unit images G1 is arranged such that only one first unit image G1 is provided on each row or each column of the first pattern image for printing P11. The pattern images for printing P11 to P17 are configured such that the unit images thereof gradually become larger towards one side (right side in FIG. 7A) of the main scanning direction as the exposure density increases.

In contrast, the first pattern image for detection D11 has a configuration where 18 unit images per predetermined area, i.e., the first unit images G1 more than the first pattern image for printing P11 are arranged in a ratio of one per 5 cells with being spaced from each other. The plurality of first unit images G1 is provided such that four unit images are positioned at an interval on first, fifth and ninth rows of the first pattern image for detection D11 and three unit images are positioned at an interval on third and seventh rows. Each of the first unit images G1 positioned on the third and seventh rows deviates from each of the first unit images G1 positioned on the first, fifth and ninth rows in the main scanning direction.

The second pattern image for detection D12 has the more second unit images G2 than the second pattern image for printing P12, specifically, the ten second unit images G2 in a ratio of one per 8 cells. The second unit images G2 are arranged two by two on odd rows of the second pattern image for detection D12. Each of the second unit images G2 positioned on the third and seventh rows deviates from each of the second unit images G2 positioned on the first, fifth and ninth rows in the main scanning direction.

The pattern images for detection D13 to D17 of the exposure density 20% and thereafter have the same structures as the pattern images for printing P13 to P17 of the exposure density 20% and thereafter. Also in this case, in the low density area of the exposure density 10% or less, the unit images G1, G2 configuring the pattern images for detection D11, D12 are more than the pattern images for printing P11, P12 and are arranged with being spaced. Therefore, it is possible to accomplish the same effects as the above illustrative embodiment.

Also, as shown in FIGS. 8A and 8B, pattern images for printing P21 to P27 and pattern images for detection D21 to D27 may be adopted.

Specifically, in the shown forms, the first pattern image for printing P21 is an image obtained by cutting 6×8 cells from the pattern for printing corresponding to the exposure density 5%. The first pattern image for printing P21 has a configuration where two first unit images G21 are arranged in a ratio of one per 4 columns with being spaced from each other. The two first unit images G21 are formed to extend from a first row to a sixth row on first and fifth columns of the first pattern image for printing P21. The pattern images for printing P21 to P27 are configured such that the unit images thereof gradually become larger towards one side (right side in FIG. 8A) of the main scanning direction as the exposure density increases.

In contrast, the first pattern image for detection D21 has a configuration where 4 unit images per predetermined area, i.e., the first unit images G21 more than the first pattern image for printing P21 are arranged in a ratio of one per 2.5 cells with being spaced from each other. The plurality of first unit images G21 is provided on first, third, sixth and eighth columns of the first pattern image for detection D21.

The second pattern image for detection D22 has the more second unit images G22 than the second pattern image for printing P22, specifically, the three second unit images G22 in a ratio of one per 2.75 columns. The second unit images G22 are arranged such that one extends over the first column of the second pattern image for detection D22, one extends over the third and fourth columns and one extends over the sixth and seventh columns.

The pattern images for detection D23 to D27 of the exposure density 20% and thereafter have the same structures as the pattern images for printing P23 to P27 of the exposure density 20% and thereafter. Also in this case, in the low density area of the exposure density 10% or less, the unit images G21, G22 configuring the pattern images for detection D21, D22 are more than the pattern images for printing P21, P22 and are arranged with being spaced. Therefore, it is possible to accomplish the same effects as the above illustrative embodiment.

Also, as shown in FIGS. 9A and 9B, pattern images for printing P31 to P37 and pattern images for detection D31 to D37 may be adopted.

Specifically, in the shown forms, the first pattern image for printing P31 is an image obtained by cutting 6×8 cells from the pattern for printing corresponding to the exposure density 5%. The first pattern image for printing P31 has a configuration where four first unit images G31 are arranged in a ratio of one per 12 cells with being spaced from each other. The four first unit images G31 are arranged two by two at an interval on first and fourth rows of the first pattern image for printing P31. The pattern images for printing P31 to P37 are configured such that the unit images thereof gradually become larger towards one side (lower side in FIG. 9A) of the sub-main scanning direction as the exposure density increases.

In contrast, the first pattern image for detection D31 has a configuration where 6 unit images, i.e., the first unit images G31 more than the first pattern image for printing P31 are arranged in a ratio of one per 8 cells with being spaced from each other. The plurality of first unit images G31 is arranged two by two at an interval in the main scanning direction on odd rows of the first pattern image for detection D31, and each of the first unit images G31 on the third row deviates from each of the first unit images G31 on the first and fifth rows in the main scanning direction.

The second pattern image for detection D32 has the more second unit images G32 than the second pattern image for printing P32, specifically, the six second unit images G32 in a ratio of one per 9 cells. The second unit images G32 are arranged tow by two at an interval in the sub-scanning direction on the first, fourth and seventh columns of the second pattern image for detection D32.

The pattern images for detection D33 to D37 of the exposure density 20% and thereafter have the same structures as the pattern images for printing P33 to P37 of the exposure density 20% and thereafter. Also in this case, in the low density area of the exposure density 10% or less, the unit images G31, G32 configuring the pattern images for detection D31, D32 are more than the pattern images for printing P31, P32 and are arranged with being spaced. Therefore, it is possible to accomplish the same effects as the above illustrative embodiment.

In the above illustrative embodiment, the pattern image for printing is directly transferred from the photosensitive drum 51 to the sheet S. However, the disclosure is not limited thereto. For example, the pattern image for printing may be transferred from the photosensitive drum to an intermediate transfer belt and then the pattern image for printing on the intermediate transfer belt may be transferred to the sheet.

In the above illustrative embodiment, the photosensitive drum 51 has been exemplified as the photosensitive member. However, the disclosure is not limited thereto. For example, a belt-shaped photosensitive member may also be adopted.

In the above illustrative embodiment, the toner patch formed on the conveyor belt 73 is detected by the patch detection sensor 75. However, the disclosure is not limited thereto. For example, a toner patch formed on the photosensitive member may be detected by the patch detection sensor.

In the above illustrative embodiment, the LED unit 40 has been exemplified as the exposure unit. However, the disclosure is not limited thereto. For example, the exposure unit may be a scanner configured to irradiate laser light.

In the above illustrative embodiment, the transfer roller 74 has been exemplified as the transfer unit. However, the disclosure is not limited thereto. For example, the transfer unit may be any member to which a transfer bias is to be applied, such as a conductive brush, a conductive plate spring and the like.

In the above illustrative embodiment, the sheet S such as thick sheet, postcard, think sheet and the like has been exemplified as the recording sheet. However, the disclosure is not limited thereto. For example, an OHP sheet may also be adopted.

In the above illustrative embodiment, the disclosure is applied to the color printer 1. However, the disclosure is not limited thereto. For example, the disclosure can be applied to the other image forming apparatuses, too, such as a copier, a complex machine and the like.

What is claimed is:

1. An image forming apparatus comprising:

an image forming device configured to form a pattern image, in which unit images are arranged, on a photosensitive member;

a sensor to irradiate the pattern image with light and to detect reflected light; and a controller to control the image forming device to form a pattern image for printing and a pattern image for detection on the photosensitive member, the pattern image for printing being a pattern image to be used when printing, and the pattern image for detection being a pattern image to be detected by the sensor, wherein a first pattern image for printing comprises a predetermined number of first unit images, the first unit images being arranged to be spaced from each other per a predetermined area, each of the first unit images being smaller than a predetermined size, and wherein a first pattern image for detection, which directly corresponds to the first pattern image for printing, comprises a predetermined number of the first unit images greater than the predetermined number of the first unit images of the first pattern image for printing, the first unit images being arranged to be spaced from each other per the predetermined area.

2. The image forming apparatus according to claim 1, wherein the controller:

detects the pattern image for detection corresponding to the pattern image for printing; and changes a size of a unit image of the pattern image for printing corresponding to a predetermined printing density based on a result of the detection.

3. The image forming apparatus according to claim 1, wherein the pattern image for printing comprises a predetermined number of unit images arranged per the predetermined area, a size of a unit image increasing as a printing density increases.

4. The image forming apparatus according to claim 1, wherein the first pattern image for printing comprises the smallest unit images among the unit images.

5. The image forming apparatus according to claim 1, wherein the image forming device comprises:

an exposure device to form an electrostatic latent image on the photosensitive member;

a developing device to supply developer to the electrostatic latent image on the photosensitive member to form the pattern image;

a belt contactable with the photosensitive member; and a transfer device to transfer the pattern image on the photosensitive member to the belt, and wherein the controller is to perform:

printing control comprising:

forming the pattern image for printing on the photosensitive member; and transferring the pattern image for printing from the photosensitive member to a recording sheet directly or via the belt; and detection control comprising:

forming the pattern image for detection on the photosensitive member;

transferring the pattern image for detection from the photosensitive member to the belt; and detecting the pattern image for detection on the belt by the sensor.

6. The image forming apparatus according to claim 1, wherein the controller is to:

control the image forming device to form the pattern image for detection corresponding to a printing density;

control the sensor to detect a density of the pattern image for detection; and correct a relation between the printing density and the pattern image for detection.

7. A control method of an image forming device, the image forming device being configured to form a pattern image for printing and a pattern image for detection on a photosensitive member, the pattern image for printing being a pattern image to be used upon printing and the pattern image for detection being a pattern image to be detected by a sensor using light, the control method comprising:

controlling the image forming device to form a first pattern image for printing on the photosensitive member, the first pattern image for printing comprising a predetermined number of first unit images, the first unit images being arranged to be spaced from each other per a predetermined area, each of the first unit images being smaller than a predetermined size; and controlling the image forming device to form a first pattern image for detection directly corresponding to the first pattern image for printing on the photosensitive member, the first pattern image for detection comprising a predetermined number of the first unit images greater than the predetermined number of the first unit images of the first pattern image for printing, the first unit images being arranged to be spaced from each other per the predetermined area.

8. The control method according to claim 7, wherein the method comprises controlling the image forming device to form the pattern image for printing comprising a predetermined number of unit images arranged per the predetermined area, a size of a unit image increasing as a printing density increases.

9. The control method according to claim 8, wherein the method comprises controlling the image forming device to form the first pattern image for printing comprising the smallest unit images among the unit images.

10. A non-transitory computer-readable medium having a computer program stored thereon and readable by a controller to control an image forming device, the image forming device being configured to form a pattern image for printing and a pattern image for detection on a photosensitive member, the pattern image for printing being a pattern image to be used upon printing and the pattern image for detection being a pattern image to be detected by a sensor using light, the computer program, when executed by a computer, causes the controller to:

form a first pattern image for printing on the photosensitive member, the first pattern image for printing comprising a predetermined number of first unit images, the first unit images being arranged to be spaced from each other per a predetermined area, each of the first unit images being smaller than a predetermined size; and form a first pattern image for detection directly corresponding to the first pattern image for printing on the photosensitive member, the first pattern image for detection comprising a predetermined number of the first unit images greater than the predetermined number of the first unit images of the first pattern image for printing, the first unit images being arranged to be spaced from each other per the predetermined area.

11. The non-transitory computer-readable medium according to claim 10, wherein the computer program, when executed by the computer, causes the controller to form the pattern image for printing, comprising a predetermined number of unit images arranged per the predetermined area, a size of a unit image increasing as a printing density increases.

12. The non-transitory computer-readable medium according to claim 11, wherein the computer program, when executed by the computer, causes the controller to form the first pattern image for printing comprising the smallest unit images among the unit images.

13. The image forming apparatus according to claim 1, wherein a second pattern image for printing comprises a predetermined number of second unit images, the second unit images being arranged to be spaced from each other per the predetermined area, each of the second unit images being smaller than the predetermined size and larger than the first unit images, and wherein a second pattern image for detection, which corresponds to the second pattern image for printing, comprises second unit images, the second unit images being arranged to be spaced from each other per the predetermined area, a number of the second unit images being more than the predetermined number and less than a number of the first unit images included in the first pattern image for detection.

14. The image forming apparatus according to claim 1, wherein a third pattern image for printing comprises a predetermined number of third unit images, the third unit images being arranged to be spaced from each other per the predetermined area, each of the third unit images being greater than or equal to the predetermined size, and wherein a third pattern image for detection, which corresponds to the third pattern image for printing, comprises the predetermined number of third unit images, the third unit images being arranged to be spaced from each other per the predetermined area.

15. The control method according to claim 7, wherein a second pattern image for printing comprises a predetermined number of second unit images, the second unit images being arranged to be spaced from each other per the predetermined area, each of the second unit images being smaller than the predetermined size and larger than the first unit images, and wherein a second pattern image for detection, which corresponds to the second pattern image for printing, comprises second unit images, the second unit images being arranged to be spaced from each other per the predetermined area, a number of the second unit images being more than the predetermined number and less than a number of the first unit images included in the first pattern image for detection.

16. The control method according to claim 7, wherein a third pattern image for printing comprises a predetermined number of third unit images, the third unit images being arranged to be spaced from each other per the predetermined area, each of the third unit images being greater than or equal to the predetermined size, and wherein a third pattern image for detection, which corresponds to the third pattern image for printing, comprises the predetermined number of third unit images, the third unit images being arranged to be spaced from each other per the predetermined area.

17. The non-transitory computer-readable medium according to claim 10, wherein a second pattern image for printing comprises a predetermined number of second unit images, the second unit images being arranged to be spaced from each other per the predetermined area, each of the second unit images being smaller than the predetermined size and larger than the first unit images, and wherein a second pattern image for detection, which corresponds to the second pattern image for printing, comprises second unit images, the second unit images being arranged to be spaced from each other per the predetermined area, a number of the second unit images being more than the predetermined number and less than a number of the first unit images included in the first pattern image for detection.

18. The non-transitory computer-readable medium according to claim 10, wherein a third pattern image for printing comprises a predetermined number of third unit images, the third unit images being arranged to be spaced from each other per the predetermined area, each of the third unit images being greater than or equal to the predetermined size, and wherein a third pattern image for detection, which corresponds to the third pattern image for printing, comprises the predetermined number of third unit images, the third unit images being arranged to be spaced from each other per the predetermined area.

* * * * *